US005201602A

United States Patent [19]

Repasky

[11] Patent Number: 5,201,602

[45] Date of Patent: Apr. 13, 1993

[54] PAVING BLOCK ASSEMBLY AND PAVING BLOCKS THEREFOR

[75] Inventor: John Repasky, Hanover, Pa.

[73] Assignee: Hanover Architectural Products, Inc., Hanover, Pa.

[21] Appl. No.: 755,183

[22] Filed: Sep. 5, 1991

Related U.S. Application Data

[63] Continuation-in-part of Ser. No. 666,702, Mar. 8, 1991, abandoned.

[51] Int. Cl.[5] ..... E01C 5/00

[52] U.S. Cl. ..... 404/41; 404/42; 52/311; 52/608

[58] Field of Search ..... 404/42, 41, 37, 38, 404/39; 52/311, 575, 589, 596, 604, 608; D25/116, 138, 140

[56] References Cited

U.S. PATENT DOCUMENTS

| | | |
|---|---|---|
| D. 31,450 | 8/1899 | Thomas . |
| D. 171,470 | 2/1954 | Toohey . |
| D. 177,897 | 6/1956 | Carver . |
| D. 218,604 | 9/1970 | Benoit . |
| D. 238,870 | 2/1976 | Appleton . |
| D. 263,082 | 2/1982 | Hass . |
| 250,456 | 12/1881 | Sellers . |
| 1,361,501 | 12/1920 | Schepmoes . |
| 1,474,779 | 11/1923 | zur Kammer . |
| 2,025,496 | 12/1935 | Courtois . |
| 2,053,001 | 9/1936 | Haliburton . |
| 3,602,111 | 8/1971 | Clemente . |
| 3,870,423 | 3/1975 | Peitz, Jr. . |
| 3,947,192 | 3/1976 | Rosenberger . |
| 3,996,715 | 12/1976 | Dowse . |
| 4,125,341 | 11/1978 | Reinschutz . |
| 4,128,357 | 12/1978 | Barth et al. . |
| 4,133,152 | 1/1979 | Penrose . |
| 4,262,467 | 4/1981 | Faisant et al. . |
| 4,496,266 | 1/1985 | Ruckstuhl . |
| 4,572,699 | 2/1986 | Rinninger . |
| 4,620,998 | 11/1986 | Lalvani . |
| 4,711,599 | 12/1987 | Glickman . |
| 4,907,909 | 3/1990 | Ruckstahl ..... 404/37 |

FOREIGN PATENT DOCUMENTS

| | | |
|---|---|---|
| 2407621 | 8/1975 | Fed. Rep. of Germany . |
| 2474555 | 7/1981 | France . |
| 669816A | 4/1989 | Switzerland . |
| 2012332A | 7/1979 | United Kingdom . |

OTHER PUBLICATIONS

P.C. S.p.A. sales brochure, "Immagini Paver Per L'Arredo Urbano".

Hanover Architectural Products, Inc. sales brochure, "Concrete Brick Pavers—*Traditional TM Style*", 1991.

*Primary Examiner*—William P. Neuder

*Attorney, Agent, or Firm*—Finnegan, Henderson, Farabow, Garrett & Dunner

[57] ABSTRACT

A paving block assembly and first and second paving blocks therefor. The first and second paving blocks are combined to form a continuous paving surface. Spacers are provided on the blocks for assuring, among other things, correct positioning of the blocks in a continuous paving surface. The paving blocks have concave and convex curved side surfaces, which increase the durability of the paving blocks. The paving blocks in the paving block assembly form an arch shaped pattern, which increases the stability of the paving block assembly.

38 Claims, 3 Drawing Sheets

PAVING BLOCK ASSEMBLY AND PAVING BLOCKS THEREFOR

BACKGROUND OF THE INVENTION

The present application is a continuation in part of utility patent application Ser. No. 07/666,702, filed Mar. 8, 1991, which application is incorporated herein.

FIELD OF THE INVENTION

The present invention relates to a paving block assembly and paving blocks for forming the paving block assembly.

DESCRIPTION OF THE RELATED ART

Paving blocks are interconnected to, for example, form pathways or roadways. A majority of the force applied against the paving blocks is usually applied against the top. However, the paving blocks are often subjected to force in the lateral direction. This force can be applied by pedestrian or vehicular acceleration, deceleration, or turning. When the paving blocks are positioned on a grade, the acceleration of gravity can also generate a force on the paving blocks in the lateral direction. The force applied in the lateral direction due to the force of gravity can become especially significant when the paving blocks are in position for a long period of time and subjected to vibration.

When lateral forces are applied to a paving block, the paving block transmits the forces to adjacent paving blocks at a point or points of contact between the paving blocks. The ability of the adjacent paving blocks to resist lateral forces determines the paving block assembly's ability to remain stabilized and intact.

When a paving block has a flat or planar side surface, the transmission of a lateral force by the paving block and corresponding resistance to the force by an adjacent paving block occur along the flat side surface of the paving block When loads are applied along a flat side surface, the paving block or the adjacent paving block may crack due to point loading or stress caused by rotational forces A crack diminishes the paving block's ability to resist forces applied against it. A crack in the paving block also increases the paving block's susceptibility to damage caused by water and freeze/-thaw cycles. Such damage causes the paving blocks to deteriorate and decreases their effective life span.

A paving block having a flat side surface can also cause the force transmission and corresponding resistance to occur at a corner of the paving block. When force transmission occurs at a corner, the corner is sometimes crushed, thereby reducing the paving block's ability to resist forces. The crushed corner can also increase the paving block's vulnerability to damage due to water and freeze/thaw cycles.

SUMMARY OF THE INVENTION

An object of the invention is to provide paving blocks which are able to transmit and resist lateral forces without the problems encountered by previous paving blocks.

Another object of the invention is to provide paving blocks which have improved effective life spans over previous paving blocks.

Another object of the invention is to provide a paving block assembly having improved lateral stability over previous paving block assemblies.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises a first paving block a top surface, a bottom surface, and side surfaces extending between the top surface and the bottom surface. The side surfaces include first and second substantially concave side surfaces, a third substantially concave side surface positioned on a first side of the paving block between the first and second concave side surfaces, and a substantially convex side surface positioned between the first and second concave side surfaces on a second side of the paving block which is opposite the first side.

To achieve the objects and in accordance with the purpose of the invention, as embodied and broadly described herein, the invention also comprises a substantially symmetrical second paving block having a line of symmetry. The second paving block includes a top surface, a bottom surface, and side surfaces extending between the top surface and the bottom surface. The side surfaces include first and second substantially convex side surfaces, the length of an arc defined by the first convex side surface being substantially equal to the length of an arc defined by the second convex side surface, the first convex side surface being disposed on a first side of the line of symmetry and the second convex side surface being disposed on a second side of the line of symmetry, and first and second substantially concave side surfaces positioned between the first and second convex side surfaces, a radius of curvature of an arc defined by the first concave side surface being substantially equal to a radius of curvature of an arc defined by the second concave side surface, and the first concave side surface being disposed on the first side of the line of symmetry and the second concave side surface being disposed on the second side of the line of symmetry.

To achieve the objects and in accordance with the purpose of the invention, as embodied and broadly described herein, the invention comprises an assembly of the above described paving blocks, the paving blocks being interconnected to form a continuous surface, the assembly including at least one repeating unit having two adjacent first paving blocks and two substantially symmetrical second paving blocks. The first concave side surface of one of the first paving blocks contacts the second convex side surface of one of the adjacent second paving blocks, the second concave side surface of the one first paving block contacts the first convex side surface of the other adjacent second paving block, and the convex side surface of the one first paving blocks contacts the third concave side surface of the other adjacent first paving block.

To achieve the objects and in accordance with the purpose of the invention, as embodied and broadly described herein, the invention also comprises an assembly of paving blocks interconnected to form a continuous surface, the assembly including at least one symmetrical first paving block and at least two second paving blocks positioned adjacent the first paving block on opposite sides of the line of symmetry, the first and second paving blocks having respective curved surfaces contacting side surfaces for forming an arched interconnection between the one first paving block and the two second paving blocks, wherein a force applied along the line of symmetry of the first paving block is bifurcated and resisted by the second paving blocks.

The paving block assembly of the present invention improves over previous paving block assemblies by, among other things, reducing damage to paving blocks caused by the transmission of lateral forces. This advantage is achieved by, for example, transmitting lateral forces along curved surfaces, as opposed to flat surfaces, by forming the side surfaces of the paving blocks in arc shapes.

Additionally, the paving blocks of the present invention can be combined to form a paving block assembly having an arch shape. The arch shaped paving block assembly distributes lateral forces to a plurality of adjacent paving blocks. The distribution of force increases the lateral stability of the paving block assembly and can decrease the force which must be borne by each of the individual paving blocks. By decreasing the force borne by each of the individual paving blocks, the possibility of damage to the blocks can be decreased.

Both of the above mentioned features of the present invention improve the lateral stability of the paving block assembly and increase the life span of the paving blocks by reducing damage thereto However, the above is not an exhaustive list of the advantages of the present invention.

For example, the paving blocks of the present invention allow for easy insertion of filler material by providing spacers on the side surfaces of the paving blocks Filler material can be inserted into a gap between the paving blocks, which is provided by the spacers. The spacers are positioned such that their presence is not noticeable when the filler material has been inserted. Furthermore, the spacers improve the uniformity of spacing between the blocks.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

DESCRIPTION OF THE PREFERRED EMBODIMENTS

Reference will now be made in detail to the presently preferred embodiments of the invention, examples of which are illustrated in the accompanying drawings. Wherever possible, the same reference numbers will be used throughout the drawings to refer to the same or like parts.

Figure 1:
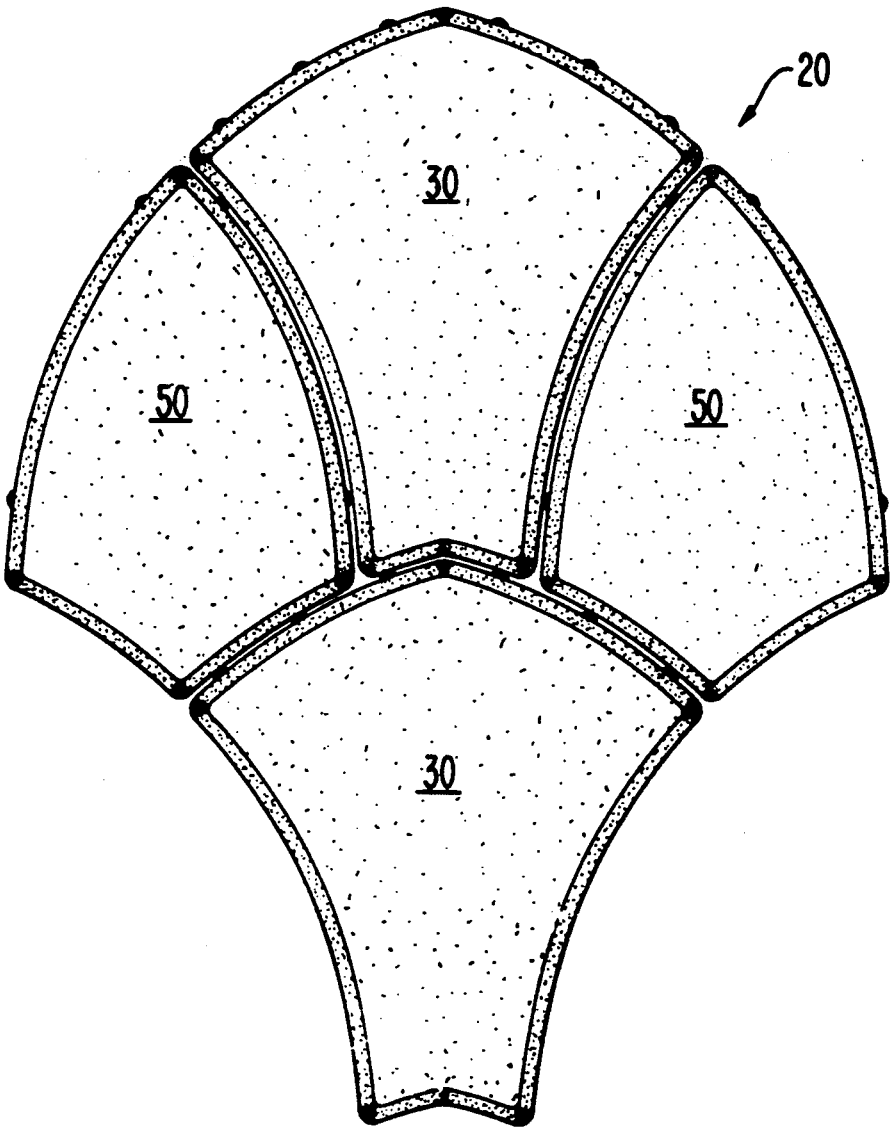
FIG. 1 is a top plan view of a preferred embodiment of the paving block assembly of the present invention.
Figure 10:
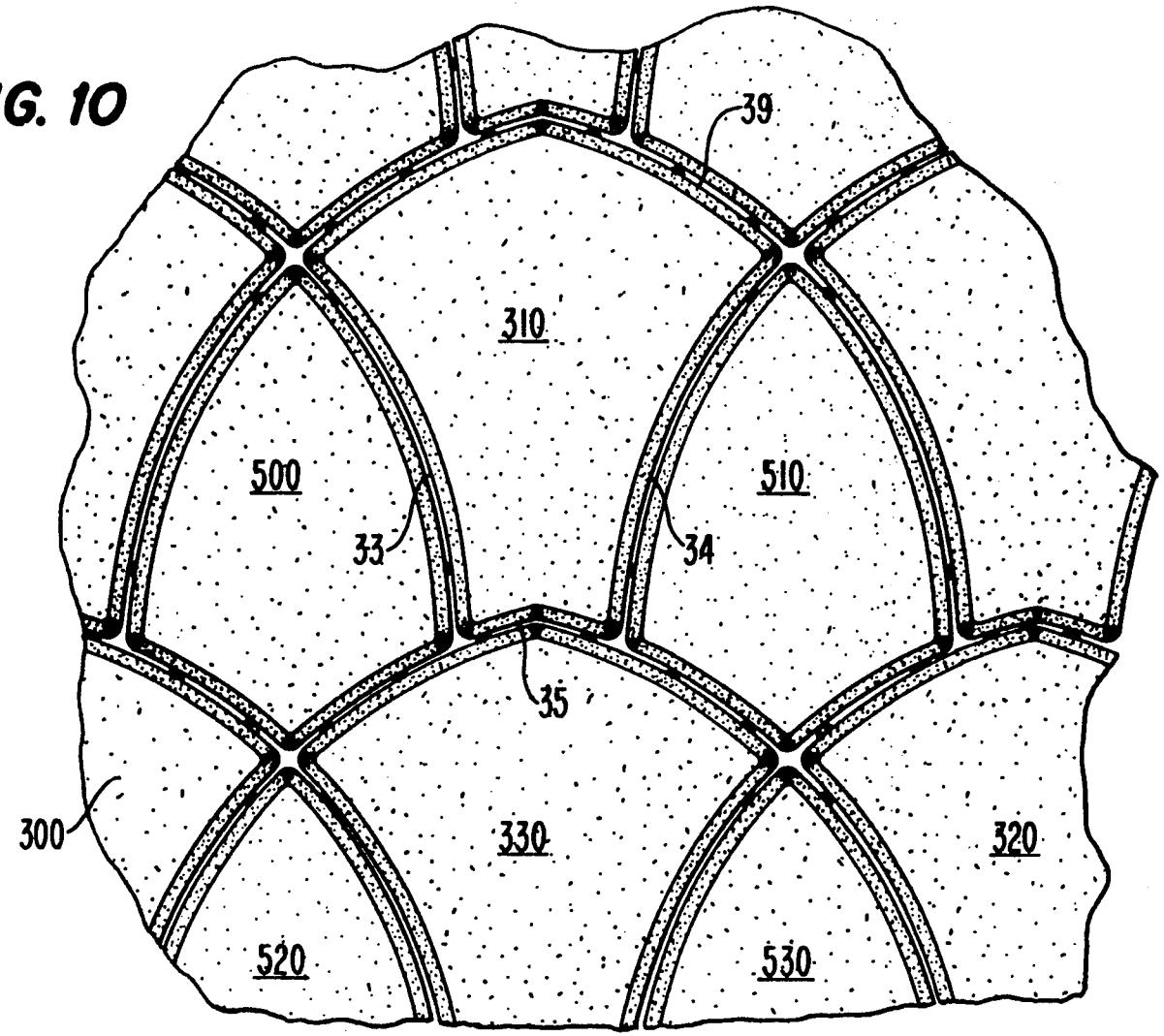
FIG. 10 is top plan view of the paving block assembly of the present invention.

In accordance with the invention, the paving block assembly 20 of the present invention includes two paving blocks of a first kind and two paving blocks of a second kind. As embodied herein, and with initial reference to FIG. 1, assembly 20 includes a plurality of first paving blocks 30 and a plurality of second paving blocks 50. The first paving blocks 30 and second paving blocks 50 can be positioned as shown in FIGS. 1 and 10 to form a continuous paved surface. As can be seen in FIG. 1, a combination of two first paving blocks 30 and two second paving blocks 50 provides a geometrical shape which is similar to the shape of a first paving block 30 and forms a common repeating unit. As show in FIG. 10, this unit can be repeated to form the paving surface Further in accordance with the present invention, the paving block of the first kind comprises a top surface, a bottom surface, and side surfaces extending between the top surface and the bottom surface The side surfaces include first, second, and third substantially concave side surfaces and a substantially convex side surface.

As embodied herein, the first paving block 30 is illustrated in FIGS. 1–5. The first paving block 30 includes a top surface 31, a bottom surface 32, and side surfaces extending between the top surface 31 and the bottom surface 32. Preferably, the first paving block 30 is symmetrical about a line of symmetry A. The top surface 31 and bottom surface 32 are preferably planar. The side surfaces are disposed at right angles to the top surface 31 and the bottom surface 32.

Preferably, the first paving block 30 has at least four side surfaces. In a more preferred embodiment, the first paving block 30 has six side surfaces.

Figure 2:
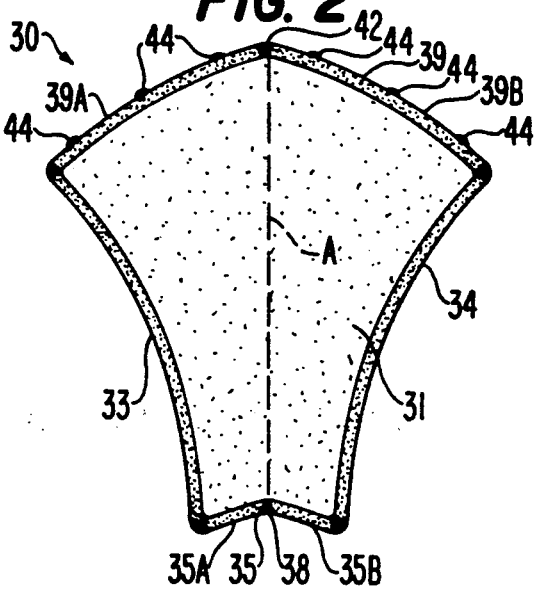
FIG. 2 is a top plan view of a preferred embodiment of a first paving block of the paving block assembly.

As shown in FIG. 2, the first paving block 30 has a first substantially concave side surface 33 and a second substantially concave side surface 34. Preferably, the length of the arcs defined by the first concave side surface 33 and the second concave side surface 34 are equal. Additionally, the radius of curvature of the arc defined by the first concave side surface 33 is equal to the radius of curvature of the arc defined by the second concave side surface 34.

A third substantially concave side surface 35 is also provided on the first paving block 30. The third concave side surface 35 is positioned between the first concave side surface 33 and the second concave side surface 34. In a preferred embodiment, the third concave side surface 35 is bisected into a first concave minor side surface 35A and a second concave minor side surface 35B. By bisecting the third concave side surface 35, a furrow 38 is formed. This furrow 38 aids in the positioning of first paving blocks 30 relative to one another. The first concave minor side surface 35A and the second concave minor side surface 35B preferably have equal arc lengths and radii of curvature.

The first paving block 30 also has a substantially convex side surface 39. The convex side surface 39 is positioned between the first concave side surface 33 and the second concave side surface 34. In a preferred embodiment, the convex side surface 39 is bisected into a first convex minor side surface 39A and a second convex minor side surface 39B. The bisection of the convex side surface 39 creates a ridge 42. The ridge 42 can be inserted into the furrow 38 of an adjacent first paving block 30 to position the first paving blocks 30 relative to one another. The length of the arc defined by the first convex minor side surface 39A is preferably equal to the length of the arc defined by the second convex minor side surface 39B. The radii of curvature of the first convex minor side surface 39A and the second convex minor side surface 39B are also equal.

In the above described preferred embodiment, the first concave side surface 33, first concave minor side surface 35A, and first convex minor side surface 39A are disposed on a first side of the line of symmetry A. The second concave side surface 34, second concave minor side surface 35B, and second convex minor side surface 39B are disposed on a second side of the line of symmetry A.

A beveled edge 43 can be formed at the intersection of the top surface 31 and the side surfaces. When the first paving block 30 has a beveled edge 43, the first paving block 30 is bilaterally symmetrical, i.e., only one plane can divide the first paving block 30 into identical halves. In a preferred embodiment, this plane must be normal to the top surface 31 and pass through the line of symmetry A.

In a particularly preferred embodiment of the first paving block 30, the radii of curvature of all the side surfaces are equal. A preferred radius of curvature is 211.25 millimeters. In the particularly preferred embodiment, the overall length of the first paving block is 205.54 millimeters, the length of a chord extending between the end points of the convex side surface 39 is 195.00 millimeters, and the length of a chord extending between the end points of the third concave side surface is 65.00 millimeters.

Additionally, spacers 44 can be provided on the side surfaces of the first paving block 30 to position the first paving blocks 30 relative to adjacent paving blocks. The spacers 44 also aid in assembly of the paving blocks by providing a gap for inserting filler material between the paving blocks. The spacers 44 are preferably an integral part of the first paving block 30 and have a rounded surface. Preferably, the spacers 44 are formed substantially in the shape of approximately one half of an elongated cylinder with a rounded top portion.

In a preferred embodiment, the spacers 44 are disposed on the first convex minor side surface 39A and the second convex minor side surface 39B. Preferably, three spacers are positioned on each of the first convex minor side surface 39A and the second convex minor side surface 39B. The spacers 44 disposed on each convex minor side surface are preferably positioned approximately 40 millimeters apart.

Figure 3:
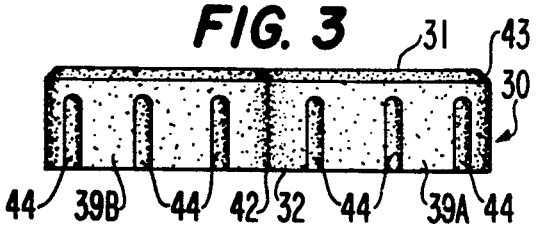
FIG. 3 is a front elevational view of the first paving block.
Figure 4:
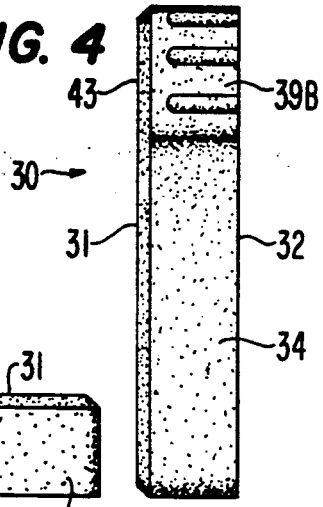
FIG. 4 is a side elevational view of the first paving block.
Figure 5:
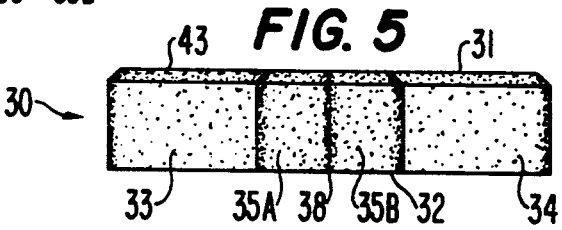
FIG. 5 is a rear elevational view of the first paving block.

As shown in FIG. 3, the spacers 44 preferably extend only part of the distance between the bottom surface 32 and the top surface 31. Preferably, the spacers 44 begin at the bottom surface 32 and extend approximately five sixths of the distance between the bottom surface 32 and the top surface 31. The spacers 44 are thereby capable of adequately spacing adjacent paving blocks, yet the spacers 44 are not visible when filler material is placed between the paving blocks.

Further in accordance with the present invention, the paving block of the second kind comprises a top surface, a bottom surface, and side surfaces extending between the top surface and the bottom surface. The side surfaces include first and second substantially convex side surfaces and first and second substantially concave side surfaces.

As embodied herein, the second paving block 50 is shown in FIGS. 1 and 6–9. Preferably, the second paving block 50 is symmetrical about a line of symmetry B. The second paving block 50 includes a top surface 51, a bottom surface 52, and side surfaces extending between the top surface 51 and the bottom surface 52. The top surface 51 and bottom surface 52 are preferably planar. The side surfaces are disposed at right angles to the top surface 51 and the bottom surface 52.

Figure 6:
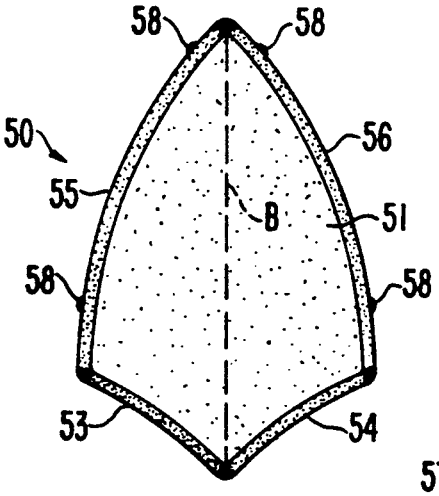
FIG. 6 is a top plan view of a preferred embodiment of a second paving block of the paving block assembly.

Preferably, the second paving block 50 has four side surfaces. As shown in FIG. 6, the second paving block 50 has a first substantially concave side surface 53 and a second substantially concave side surface 54. The length of the arcs defined by the first concave side surface 53 and the second concave side surface 54 are equal. Additionally, the radii of curvature of the arcs defined by the first concave side surface 53 and the second concave side surface 54 are also equal.

The second paving block 50 also has a first substantially convex side surface 55 and a second substantially convex side surface 56. The first convex side surface 55 and the second convex side surface 56 are positioned between the first concave side surface 53 and the second concave side surface 54. The length of the arc defined by the first convex side surface 55 is preferably equal to the length of the arc defined by the second convex side surface 56. The radii of curvature of the arcs defined by the first convex side surface 55 and the second convex side surface 56 are also equal.

The first concave side surface 53 and first convex side surface 55 are disposed on a first side of the line of symmetry B. The second concave side surface 54 and second convex side surface 56 are disposed on a second side of the line of symmetry B.

A beveled edge 57 can be formed at the intersection of the top surface 51 and the side surfaces. When the second paving block 50 has a beveled edge 57, the second paving block 50 is bilaterally symmetrical. In a preferred embodiment of the second paving block 50, as with the first paving block 30, the plane must be normal to the top surface 51 and pass through the line of symmetry B.

Additionally, spacers 58 can be provided on the side surfaces of the second paving block 50 to position the second paving blocks 50 relative to adjacent paving blocks. The spacers 58 are preferably an integral part of the second paving block 50 and have a rounded surface. Preferably, the spacers 44 are formed substantially in the shape of approximately one half of an elongated cylinder with a rounded top portion.

In a preferred embodiment, the spacers 58 are disposed on the first convex side surface 55 and the second convex side surface 56. Preferably, two spacers are positioned on each of the first convex side surface 55 and the second convex side surface 56. The spacers 58 disposed on each convex side surface are preferably positioned approximately 120 millimeters apart.

Figure 7:
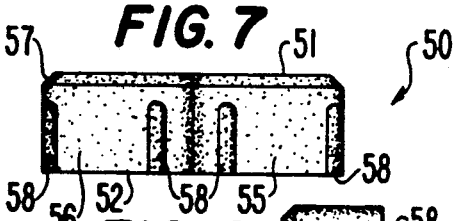
FIG. 7 is a front elevational view of the second paving block.
Figure 8:
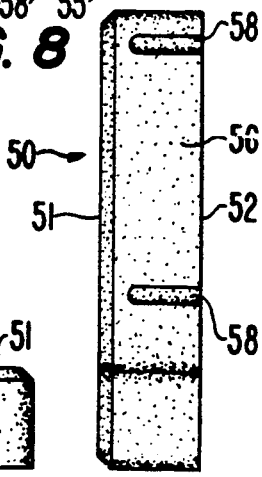
FIG. 8 is a side elevational view of the second paving block.
Figure 9:
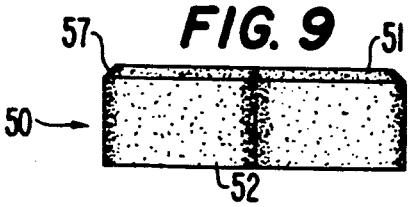
FIG. 9 is a rear elevational view of the second paving block.

As shown in FIG. 7, the spacers 58 preferably extend only part of the distance between the bottom surface 52 and the top surface 51. Preferably, the spacers 58 begin at the bottom surface 52 and extend approximately five sixths of the distance between the bottom surface 52 and the top surface 51. The spacers 58 are similar to the spacers 44 in that they separate adjacent paving blocks and are not noticeable when filler material is placed between the paving blocks.

In a particularly preferred embodiment of the second paving block 50, the radii of curvature of all the side surfaces are equal. A preferred radius of curvature is 211.25 millimeters. In the particularly preferred embodiment, the overall length of the second paving block is 195.00 millimeters and the width is 130.00 millimeters.

In a preferred embodiment, the radii of curvature of all of the side surfaces of both the first paving block 30 and the second paving block 50 are equal. However, this is not required to practice the invention. The radii of curvature of the side surfaces of the paving blocks which contact corresponding side surfaces of adjacent paving blocks, should be equal to the radii of curvature of the corresponding side surfaces to ensure a proper fit.

FIG. 10 illustrates the arch effect of the paving block assembly 20 of the present invention. An arch is formed by the first paving block 300, the second paving block 500, the first paving block 310, the second paving block 510, and the first paving block 320. The arch effect is achieved, in part, because the length of a chord extending between the end points of an arc defined by the convex side surface 39 is larger than the chord length of the arc defined by the third concave side surface 35.

If the first paving block 330 and the two second paving blocks 520, 530 are removed, the arch would maintain the integrity of the paving block assembly 20 against any lateral force applied against the convex side surface 39 of the first paving block 310. The first paving block 310 is the keystone in a traditional arch. As the lateral force is applied to the first paving block 310, it bifurcates the force and transmits lateral forces to the two adjacent second paving blocks 500, 510. Each of the two adjacent second paving blocks 500, 510 bifurcates the lateral force transmitted to them and in turn exert a lateral force on the adjacent first paving blocks 300, 330 and 330, 320, respectively. As in a traditional arch, none of the pieces can fall out because of their shapes and the combination of horizontal and vertical loads being applied.

The paving block assembly 20 of the present invention is not intended to be used with the first paving block 330 or second paving blocks 520, 530 removed. However, the fact that these paving blocks can be removed and the stability of the paving block assembly 20 can still be maintained, demonstrates one of the advantages of the present invention.

FIG. 10 also illustrates the benefits of transferring force across a curved surface. The load from one paving block is always transferred to other paving blocks along a segment of the curved surface and never at a point. For example, a load applied against the convex side surface 39 of the first paving block 310 would be resisted by the first paving block 330 and the two second paving blocks 500, 510. Likewise, if a lateral force is applied against the third concave side surface 35 of the first paving block 330, the force would be resisted by the first paving block 310 and the two second paving blocks 500, 510.

Similar force distribution exists when a lateral force is applied against the first or second concave side surfaces 33, 34 of the first paving block 310, as well as in any of these directions on the second paving block.

A paving block can be subjected to a rotating force. A rotating force can be generated when, for example, a wheel of an automobile is turned. The resistance of the paving block assembly 20 of the present invention is more complex, but the paving block assembly 20 resists the force in a similar manner. For example, a clockwise force applied to the first paving block 330 would be resisted by all of the adjacent paving blocks. The loads are transferred to adjacent blocks along segments of the curved side surfaces, in such a manner as to resist cracking or crushing of the paving blocks.

In all cases, a lateral force is transferred along curved surfaces, which distributes the force. Any lateral force applied to a first or second paving block is resisted by at least three other paving blocks. By distributing the force, the ability of the paving blocks to resist cracking and crushing is increased.

The paving assembly 20 of the present invention solves these load force transmission problems by, among other things, distributing the force across an arch and transferring forces from one paving block to another along a curved joint. Both of these features improve the lateral stability of the paving system and reduce damage to the paving blocks.

Additionally, as shown in FIG. 10, the spacers 44, 58 are positioned on the side surfaces of the paving blocks such that each paving block is separated from each adjacent paving block by at least two spacers. For example, the first paving block 310 is contacted by two spacers positioned on each of the first paving block 330, the second paving block 500, and the second paving block 510. Similarly, at least two of the six spacers on the first paving block 530 contact each of the second paving block 500, the first paving block 310, and the second paving block 510. Separating adjacent paving blocks by at least two spacers improves the accuracy of the positioning of the paving blocks. Moreover, the provision of multiple, evenly distributed spacers enhances the force distribution characteristics of the assembly, discussed above.

Furthermore, because in the preferred embodiment the spacers 44, 58 are positioned only on the convex surfaces of the paving blocks, there is no concern that the paving blocks will be improperly laid with the spacers of a paving block engaging or interfering with the spacers of an adjacent paving block. A convex surface of a paving block, which has spacers, will always mate with a concave surface of an adjacent paving block, which does not have spacers. Additionally, the ease of laying the paving block assembly is increased because the paving blocks need not be examined prior to laying to determine if they will properly mate.

The placement of spacers on the convex surface has additional advantages. For example, spacers on a convex surface cover a greater surface area of the convex surface than the same spacers would on a concave surface, thereby providing a broader base for the spacers and greater stability.

It will be apparent to those skilled in the art that various modifications and variations can be made in the paving blocks and paving block assembly of the present invention and without departing from the scope or spirit of the invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A paving block comprising:

a top surface;

a bottom surface;

side surfaces extending between the top surface and the bottom surface, the side surfaces including first and second substantially concave side surfaces, a third substantially concave side surface positioned on a first side of the paving block between the first and second concave side surfaces, and a substantially convex side surface positioned between the first and second concave side surfaces on a second side of the paving block which is opposite the first side; and at least one spacer disposed on the substantially convex side surface, the spacer having a base adjacent the convex surface and an opposing end spaced outwardly therefrom, the base having a larger cross-sectional area than the opposing end.

2. The paving block of claim 1 wherein the paving block is bilaterally symmetrical and has a line of symmetry, the first concave side surface being disposed on a first side of the line of symmetry, the second concave side surface being disposed on a second side of the line of symmetry, and the third concave side surface and the convex side surface extending across the line of symmetry.

3. The paving block of claim 1 wherein the convex side surface has a radius of curvature which is substantially equal to a radius of curvature of the third concave side surface, and the length of a chord extending between end points on the convex side surface is greater than the length of a chord extending between end points on the third concave side surface.

4. The paving block of claim 1 wherein the first concave side surface is adjacent the convex side surface, which is adjacent the second concave side surface, which is adjacent the third concave side surface, which is adjacent the first concave side surface.

5. The paving block of claim 1 wherein a radius of curvature of the first concave side surface is substantially equal to a radius of curvature of the second concave side surface.

6. The paving block of claim 5 wherein a radius of curvature of the first concave side surface is substantially equal to a radius of curvature of the convex side surface.

7. The paving block of claim 1 wherein the length of an arc defined by the first concave side surface is substantially equal to the length of an arc defined by the second concave side surface.

8. The paving block of claim 1 further comprising a beveled edge forming the intersection of the top surface and the side surfaces.

9. The paving block of claim 1 wherein the third concave side surface is bisected into first and second substantially concave minor side surfaces and the convex side surface is bisected into first and second substantially convex minor side surfaces.

10. The paving block of claim 9 wherein the length of an arc defined by the first concave minor side surface is substantially equal to the length of an arc defined by the second concave minor side surface.

11. The paving block of claim 10 wherein the length of an arc defined by the first convex minor side surface is substantially equal to the length of an arc defined by the second convex minor side surface.

12. The paving block of claim 10 wherein the paving block is symmetrical and has a line of symmetry, the first concave side surface, first concave minor side surface, and first convex minor side surface being disposed on a first side of the line of symmetry and the second concave side surface, second concave minor side surface, and second convex minor side surface being disposed on a second side of the line of symmetry.

13. The paving block of claim 1 wherein the at least one spacer extends only part of the distance between the top surface and the bottom surface.

14. The paving block of claim 13 wherein the at least one spacer extends from the bottom surface toward the top surface a distance that is a substantial portion of the total distance between said top and bottom surfaces.

15. The paving block of claim 14 wherein the distance the ar least one spacer extends is approximately five sixths of the total distance between the top surface and the bottom surface.

16. The paving block of claim 14 wherein the at least one spacer has a substantially rounded surface.

17. The paving block of claim 16 wherein the at least one spacer is in the shape of approximately one half of an cylinder with a rounded top portion.

18. The paving block of claim 9 wherein at least three spacers are disposed on each of the first convex minor side surface and the second convex minor side surface.

19. The paving block of claim 18 wherein the spacers each have a substantially rounded surface.

20. A substantially symmetrical paving block having a line of symmetry, the paving block comprising:

a top surface;

a bottom surface;

side surfaces extending between the top surface and the bottom surface, the side surfaces including first and second substantially convex side surfaces, the length of an arc defined by the first convex side surface being substantially equal to the length of an arc defined by the second convex side surface, the first convex side surface being disposed on a first side of the line of symmetry and the second convex side surface being disposed on a second side of the line of symmetry, and first and second substantially concave side surfaces positioned between the first and second convex side surfaces, a radius of curvature of an arc defined by the first concave side surface being substantially equal to a radius of curvature of an arc defined by the second concave side surface, and the first concave side surface being disposed on the first side of the line of symmetry and the second concave side surface being disposed on the second side of the line of symmetry; and at least one spacer disposed on each of the first and second substantially convex side surfaces, the spacer having a base adjacent the convex surface and an opposing end spaced outwardly therefrom, the base having a larger cross-sectional area than the opposing end.

21. The paving block of claim 20 wherein the first concave side surface is adjacent the second concave side surface, which is adjacent the second convex side surface, which is adjacent the first convex side surface, which is adjacent the first concave side surface.

22. The paving block of claim 20 wherein a radius of curvature of an arc defined by the first convex side surface is substantially equal to a radius of curvature of an arc defined by the second convex side surface.

23. The paving block of claim 22 wherein the radius of curvature of the arc defined by the first convex side surface is substantially equal to the radius of curvature of the arc defined by the first concave side surface.

24. The paving block of claim 20 wherein the top surface and the bottom surface are substantially planar and the side surfaces are disposed at substantially right angles to the top surface and bottom surface.

25. The paving block of claim 20 further comprising a beveled edge forming the intersection of the top surface and the side surfaces.

26. The paving block of claim 25 wherein the paving block is bilaterally symmetrical.

27. The paving block of claim 20 wherein the at least one spacer extends only part of the distance between the top surface and the bottom surface.

28. The paving block of claim 27 wherein the at least one spacer extends from the bottom surface toward the top surface a distance that is a substantial portion of the total distance between said top and bottom surfaces.

29. The paving block of claim 28 wherein the distance the at least one spacer extends is approximately five sixths of the total distance between the top surface and the bottom surface.

30. The paving block of claim 28 wherein the at least one spacer has a substantially rounded surface.

31. The paving block of claim 30 wherein the at least one spacer is in the shape of approximately one half of an elongated cylinder with a rounded top portion.

32. The paving block of claim 20 wherein at least two spacers are disposed on each of the first convex side surface the second convex side surface.

33. The paving block of claim 32 wherein the spacers have a substantially rounded surface.

34. An assembly of paving blocks interconnected to form a continuous surface, the assembly comprising:

at least one repeating unit having:

two adjacent first paving blocks, each of the first paving blocks including a top surface, a bottom surface, side surfaces extending between the top surface and the bottom surface, the side surfaces including first and second substantially concave side surfaces, a third substantially concave side surface positioned on a first side of the paving block between the first and second concave side surfaces, and a substantially convex side surface positioned between the first and second concave side surfaces on a second side of the paving block which is opposite the first side, and at least one first spacer disposed on the substantially convex side surface, the spacer having a base adjacent the convex surface and an opposing end spaced outwardly therefrom, the base having a larger cross-sectional area than the opposing end; and two substantially symmetrical second paving blocks, each of the second paving blocks having a line of symmetry and including a top surface, a bottom surface, side surfaces extending between the top surface and the bottom surface, the side surfaces including first and second substantially convex side surfaces, the first and second convex side surfaces having substantially equal arc lengths, the first convex side surface being disposed on a first side of the line of symmetry and the second convex side surface being disposed on a second side of the line of symmetry, and first and second substantially concave side surfaces, the first and second concave side surfaces of the second paving block being positioned between the first and second convex side surfaces, the first concave side surface being disposed on the first side of the line of symmetry and the second concave side surface being disposed on the second side of the line of symmetry, and at least one second spacer disposed on each of the first and second substantially convex side surfaces, the spacer having a base adjacent the convex surface and an opposing end spaced outwardly therefrom, the base having a larger cross-sectional area than the opposing end, wherein the first concave side surface of one of the first paving blocks is arranged adjacent the second convex side surface of one of the adjacent second paving blocks, the second concave side surface of said one first paving block is arranged adjacent the first convex side surface of the other adjacent second paving block, and the convex side surface of said one first paving block is arranged adjacent the third concave side surface of the other adjacent first paving block.

35. The assembly of claim 34 wherein the third concave side surface of the first paving block is bisected into two substantially concave side surfaces by a ridge and the convex side surface of the first paving block is bisected into two substantially convex side surfaces by a furrow for accepting a ridge from an adjacent first paving block to position the first paving block relative to the adjacent first paving block.

36. The assembly of claim 34 wherein at least six first spacers are disposed on the convex side surface of each first paving block.

37. The assembly of claim 34 wherein at least two second spacers are disposed on each of the first and second convex side surfaces of each second paving block.

38. An assembly of paving blocks interconnected to form a continuous surface, the assembly comprising:

at least one first paving block, the first paving block being substantially symmetrical and having a line of symmetry and opposing inwardly curved side surfaces;

at least two second paving blocks positioned adjacent the first paving block on opposite sides of the line of symmetry and having opposing outwardly curved side surfaces with spacers disposed thereon, the spacers having a base adjacent the outwardly curved side surfaces and an opposing end spaced outwardly therefrom, the base having a larger cross-sectional area than the opposing end, the inwardly curved side surfaces of the first paving block contacting the spacers on the outwardly curved side surfaces of the second paving block for forming an arched interconnection between said one first paving block and said two second paving blocks, wherein a force applied along the line of symmetry of the first paving block is bifurcated and resisted by the second paving blocks.

* * * * *

UNITED STATES PATENT AND TRADEMARK OFFICE

CERTIFICATE OF CORRECTION

PATENT NO. : 5,201,602

DATED : April 13, 1993

INVENTOR(S) : John REPASKY

It is certified that error appears in the above-identified patent and that said Letters Patent is hereby corrected as shown below:

Claim 15, column 10, line 19, "ar" should read --at--.

Claim 17, column 10, line 26, after "an", insert --elongated--.

Signed and Sealed this

Thirtieth Day of November, 1993

*Attest:*

*Attesting Officer*

BRUCE LEHMAN

*Commissioner of Patents and Trademarks*